US012208438B2

(12) United States Patent
Yang

(10) Patent No.: US 12,208,438 B2
(45) Date of Patent: Jan. 28, 2025

(54) POSITIONING APPARATUS FOR POSITIONING SPRING PRODUCT FED FROM SPRING COILING MACHINE

(71) Applicant: PLUSPRINGS MACHINERY CO., LTD, New Taipei (TW)

(72) Inventor: Ching-Fa Yang, New Taipei (TW)

(73) Assignee: PLUSPRINGS MACHINERY CO., LTD, New Taipei (TW)

( * ) Notice: Subject to any disclaimer, the term of this patent is extended or adjusted under 35 U.S.C. 154(b) by 364 days.

(21) Appl. No.: 17/585,080

(22) Filed: Jan. 26, 2022

(65) Prior Publication Data

US 2023/0108101 A1 Apr. 6, 2023

(30) Foreign Application Priority Data

Oct. 4, 2021 (TW) ..... 110136862

(51) Int. Cl.
*B21F 23/00* (2006.01)
*B21F 1/00* (2006.01)
*B21F 3/02* (2006.01)

(52) U.S. Cl.
CPC ..... *B21F 23/00* (2013.01); *B21F 1/004* (2013.01); *B21F 3/02* (2013.01)

(58) Field of Classification Search
CPC . B21F 23/00; B21F 1/004; B21F 3/02; B21D 43/00; B21D 43/003; B21D 43/006; B21D 43/011; B21D 11/07
USPC ..... 72/135, 133, 134
See application file for complete search history.

(56) References Cited

U.S. PATENT DOCUMENTS 2,469,405 A * 5/1949 Payne ..... B21D 11/07 72/293
4,885,926 A * 12/1989 Lisec ..... B21D 43/006 72/422
5,149,072 A * 9/1992 Sartorio ..... B21D 43/10 269/254 R

* cited by examiner

*Primary Examiner* — Adam J Eiseman
*Assistant Examiner* — Fred C Hammers
(74) *Attorney, Agent, or Firm* — Locke Lord LLP; Tim Tingkang Xia, Esq.

(57) ABSTRACT

The present invention discloses a positioning apparatus for positioning a spring product fed from a spring coiling machine. The positioning apparatus includes a first guiding panel having a first guiding surface for guiding the spring product and the first guiding surface have a length and a width; and a plurality of first mechanical holding members arranged on the first guiding surface in a direction of the length of the first guiding surface for optionally supporting and holding a first part of the spring product.

12 Claims, 17 Drawing Sheets

POSITIONING APPARATUS FOR POSITIONING SPRING PRODUCT FED FROM SPRING COILING MACHINE

BACKGROUND OF THE INVENTION

Field of the Invention

The present invention relates to positioning apparatuses and, more particularly, to a positioning apparatus for positioning a spring product fed from a spring coiling machine, the positioning apparatus being separate from a main processing interface of the spring coiling machine.

Description of the Prior Art

The processing capability of a spring coiling machine is determined by customized processing tools installed on a base according to the form of the spring product. However, the design of the base of the spring coiling machine cannot satisfy manufacturing of diversified spring products. For example, a space configuration of multiple processing tools is designed for the assembly of a conventional spring coiling machine according to spring forms, and these processing tools are not in a modularized design but are usually arranged around wire guides in a manner similar to a radial form. A motion stroke of the processing tools is determined at the base to manufacture springs of a specific form, meaning that a common spring coiling machine can only manufacture one single type of springs. In the prior art, the processing tools configured for a spring coiling machine need to be redesigned if springs in a different form are to be manufactured. Accompanied by complexity levels of spring structures or manufacturing of different product forms, the number of processing tools is inevitably increased, and this affects the motion strategy of the processing tools within a limited space and results in complications in installation positions of the processing tools. Therefore, the manufacturing capability of such conventional spring coiling machines is limited.

Moreover, processing tools arranged in a common spring coiling machine may not be able to handle manufacturing of large-sized springs. Despite that the configuration of common processing tools can implement various types of bending of spring wires, these processing tools used for bending spring wires lack the ability for supporting large-sized springs. This is a challenge faced in the manufacturing of large-sized springs.

Therefore, there is a need for a positioning apparatus adapted to coordinate with a spring coiling machine and capable of maintaining a spring wire at an appropriate position, so as to ensure that processing tools can perform various bending operations precisely.

SUMMARY OF THE INVENTION

It is an object of the present invention to provide a positioning apparatus for positioning a spring product fed from a spring coiling machine. The positioning apparatus includes a positioning assembly. The positioning assembly includes: a first guiding panel, having a first guiding surface for guiding the spring product, the first guiding surface having a length and a width; and a plurality of first mechanical holding members arranged on the first guiding surface in a direction of the length of the first guiding surface for selectively supporting and holding a first part of the spring product. The first guiding panel is configured to be rotatable according to a shaft, and the shaft is parallel to the direction of the length of the first guiding surface, such that the spring product held on the first guiding panel is rotatable in synchronization with the first guiding panel.

In a specific embodiment, the positioning apparatus is further mechanically connected to a spring coiling machine, and a spring wire feed direction of the spring coiling machine is parallel to the direction of the length of the first guiding surface.

In a specific embodiment, the positioning apparatus further includes: a second guiding panel, connected to the first guiding panel and having a second guiding surface for guiding the spring product, the second guiding surface having a length and a width, wherein the direction of the length of the first guiding surface is parallel to a direction of the width of the second guiding surface.

In a specific embodiment, the positioning apparatus further includes: a second mechanical holding member, arranged on the second guiding surface, and selectively supporting and holding a second part of the spring product, wherein the first part and the second part of the spring product are not parallel.

In a specific embodiment, the first guiding panel includes multiple support boards arranged in the direction of the length of the first guiding surface. Each of the support boards has a support surface having a length and a width, and each of the support boards is pivotally connected to the first guiding surface, such that each of the support boards pivotally rotates between a retracted position and a support position. The support surface of the support board at the retracted position is parallel to the first guiding surface of the first guiding panel, and the support surface of the support board at the support position is perpendicular to the first guiding surface of the first guiding panel such that the support surface supports the spring product being fed.

In a specific embodiment, the first guiding panel is movably connected to a lift assembly, so that a shaft position of the first guiding panel is movable in a vertical direction relative to the lift assembly.

In a specific embodiment, the lift assembly is movably connected to a first platform assembly, so that the lift assembly is movable in a first horizontal direction relative to the first platform assembly, wherein the first horizontal direction is parallel to the shaft.

In a specific embodiment, the first platform assembly is movably connected to the second platform assembly, so that the first platform assembly is movable in a second horizontal direction relative to the second platform assembly, wherein the first horizontal direction is not parallel to the second horizontal direction.

In a specific embodiment, the spring coiling machine has a base which has a mechanical surface. The spring coiling machine includes: a spring wire feed outlet, arranged on the mechanical surface to feed a spring wire in the spring wire feed direction; a horizontal platform assembly, arranged on the mechanical surface and located above or below the spring wire feed outlet, the horizontal platform movably connected to the mechanical surface via one or more horizontal tracks; and a vertical platform assembly, arranged on the mechanical surface and located on one of two sides of the spring wire feed outlet, the vertical platform movably connected to the mechanical surface via one or more vertical tracks.

In a specific embodiment, a length of the horizontal track is greater than a length of the vertical track, the horizontal track protrudes from the mechanical surface and the vertical track is correspondingly accommodated in multiple recesses formed on the mechanical surface, such that a distance between the horizontal platform and the mechanical surface is greater than a distance between the vertical platform and the mechanical surface, thereby reducing motion interference between the horizontal platform and the vertical platform.

BRIEF DESCRIPTION OF THE DRAWINGS

Reference can be made to the drawings and description below to better understand the present invention. Non-limiting and non-exhaustive embodiments are described with reference to the drawings below. It is to be noted that the elements in the drawings are not necessarily drawn to their actual sizes, and are depicted to focus on the description of structures and principles.

DETAILED DESCRIPTION OF THE EMBODIMENTS

To better describe the present invention, specific examples and specific embodiments are illustrated with the accompanying drawings below. However, the subject matter of the present application may be specifically implemented in various different forms, and the construction covered or claimed by the subject matter of the present application is not limited to any exemplary specific embodiments disclosed in this specification; it should be understood that the specific embodiments are for illustrative purpose only. Similarly, the present invention is to provide a reasonably broad scope for the subject matter applied or covered by the subject matter.

The expression "in one embodiment" used in this specification does not necessarily refer to the same specific embodiment, and the expression "in other (some/certain) embodiments" used in this specification does not necessarily refer to different specific embodiments. The object of the above is, for example, to include combination of all or part of the exemplary specific embodiments by the subject matter set forth.

Figure 1:
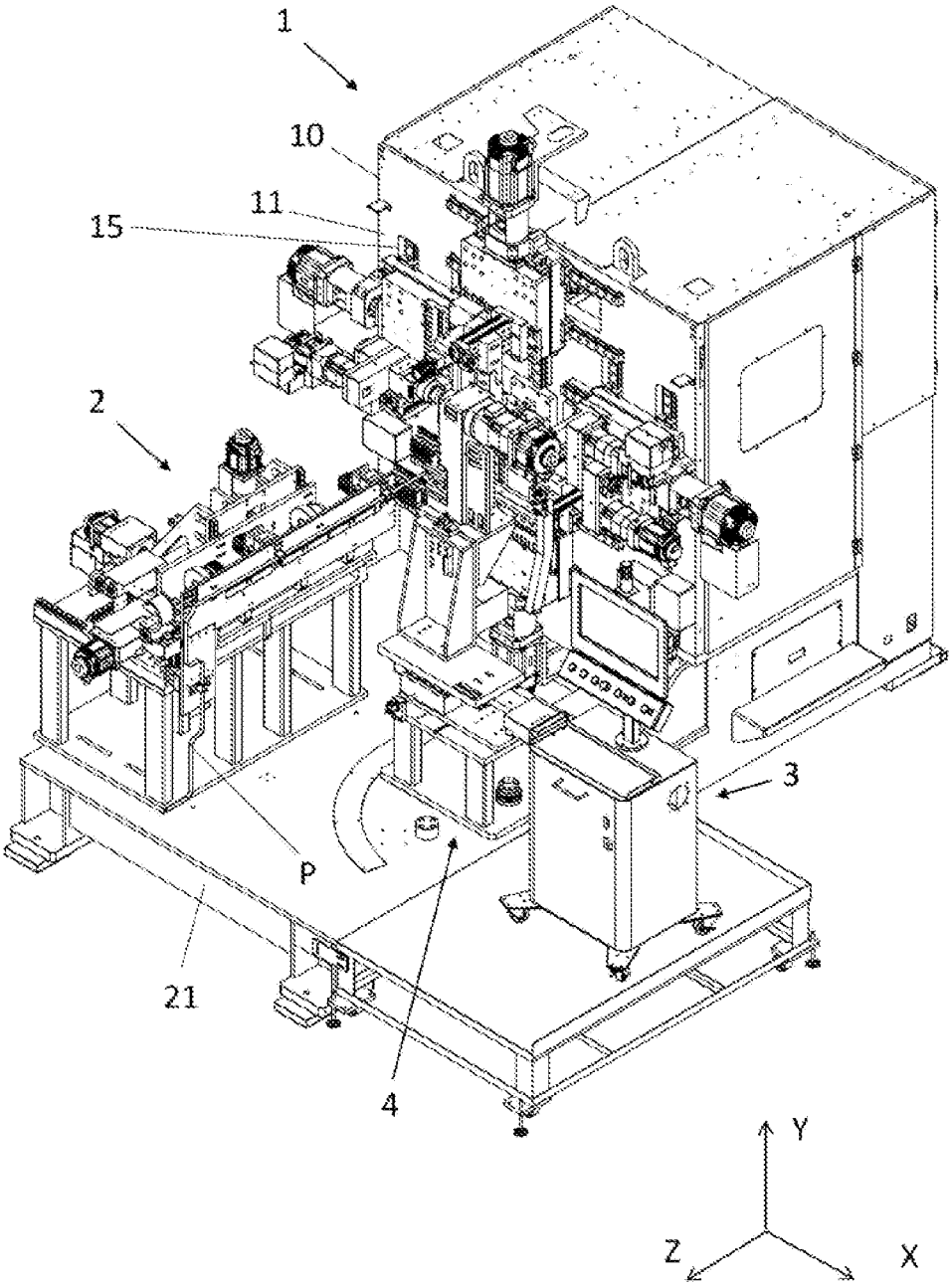
FIG. 1 is a diagram illustrating an exemplary combination of a spring coiling machine and a positioning apparatus provided by the present invention.

FIG. 1 shows a spring coiling machine (1) which is fundamentally a box having a width extending in the X direction, a height extending in the Y direction and a depth extending in the Z direction. The box is connected to a spring coil drum (not shown) on one side in the Z direction, and the spring wire extends from the drum into the box. The spring wire may be a cylindrical wire or a strip-like wire. A known mechanical assembly for feeding the spring wire is accommodated in the box. The box includes a base (10) in the +Z direction, and the base (10) is fundamentally a plate. The base (10) is provided with a mechanical surface (11) on an outer side facing the box. The mechanical surface (11) is mounted with necessary processing tools for manufacturing springs to bend and shape a fed spring wire by the processing tools on the mechanical surface (11).

Figure 2:
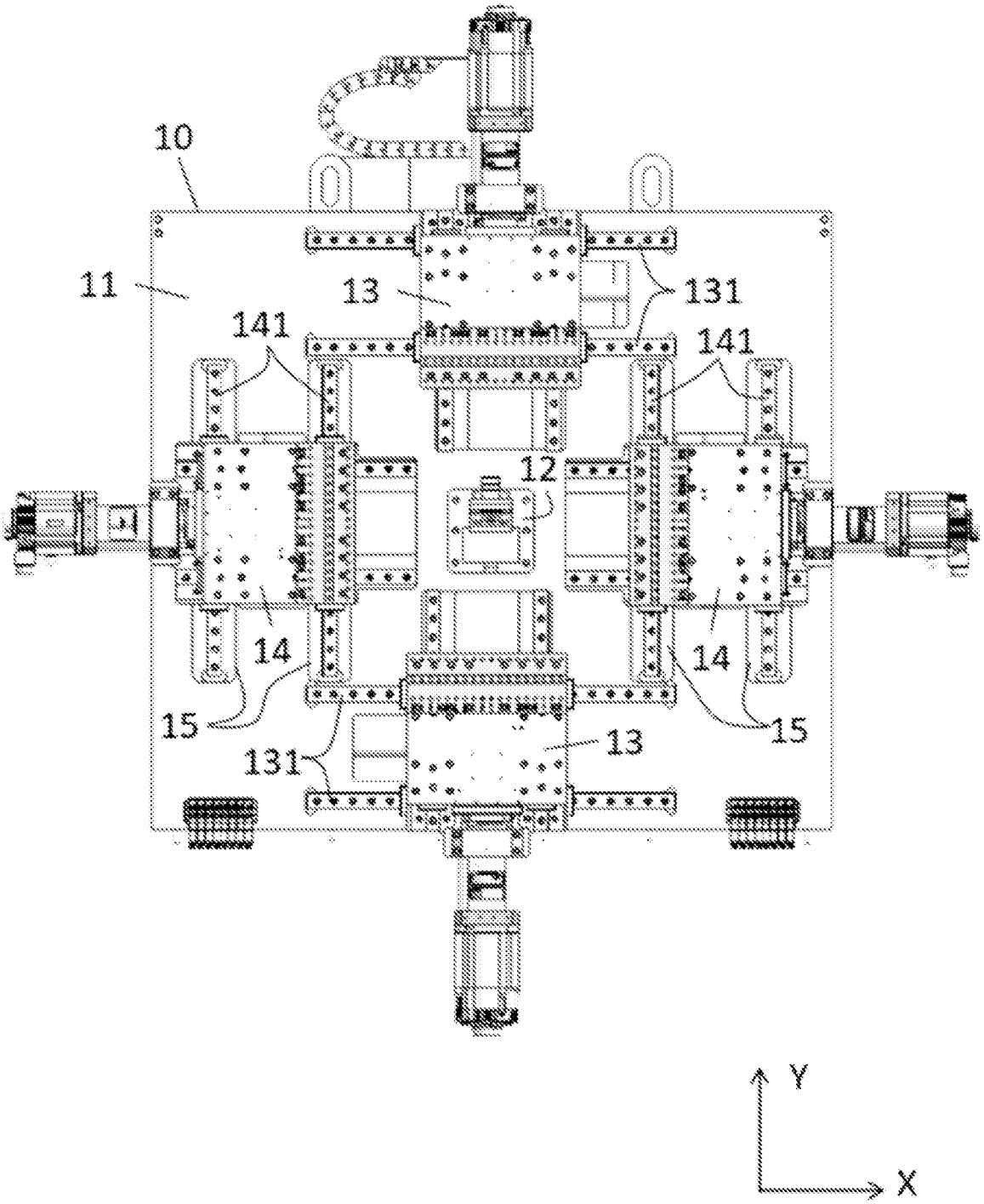
FIG. 2 is a front view of a base of the spring coiling machine (with a platform residing at the center of a track)

FIG. 2 shows a front view of the base (10) in FIG. 1. A spring wire feed outlet (12) is substantially arranged at the center of the mechanical surface (11), and the spring wire is forwarded from inside the box through the feed outlet (12) to the outer side of the mechanical surface (11). A feed direction of the spring wire is substantially perpendicular to the mechanical surface (11), that is, the +Z direction; however, the present invention is not limited to the example above. One or two horizontal platforms (13) are movably connected to the mechanical surface (11) and are respectively located above and below the feed outlet (12). The horizontal platform (13) is movably connected to the mechanical surface (11) via one or more horizontal tracks (131), and so the horizontal platform (13) is driven to move in a horizontal direction (the X direction) relative to the mechanical surface (11). One or two vertical platforms (14) are movably connected to the mechanical surface (11) and are respectively located on two sides the feed outlet (12). The vertical platform (14) is movably connected to the mechanical surface (11) via one or more vertical tracks (141), and so the vertical platform (14) is driven to move in a vertical direction (the Y direction) relative to the mechanical surface (11). The horizontal platform (13) and the vertical platform (14) may have similar structures, and each includes a flat mounting interface for selectively fixedly connecting to various processing tools, so as to meet requirements of different spring products.

As shown in FIG. 2, two ends of the horizontal track (131) close to the feed outlet (12) are respectively close to two ends of the vertical track (141), so that the vertical track (141) close to the feed outlet (12) extends between the upper and lower horizontal tracks (131); however, the present invention is not limited to the example above. Referring to FIG. 1 and FIG. 2, in order to create maximum motion strokes for the horizontal platform (13) and the vertical platform (14), the mechanical surface (11) of the present invention has multiple recesses (15) formed thereon for correspondingly accommodating the vertical tracks (141), so that the vertical tracks (141) are closer to the −Z direction compared to the horizontal tracks (131), and the vertical platform (14) is also closer to the −Z direction compared to the horizontal platform (13). In other words, when the horizontal platform (13) and the vertical platform (14) have similar structures, a distance between the horizontal platform (13) and the mechanical surface (11) is greater than a distance between the vertical platform (14) and the mechanical surface (11).

Figure 3:
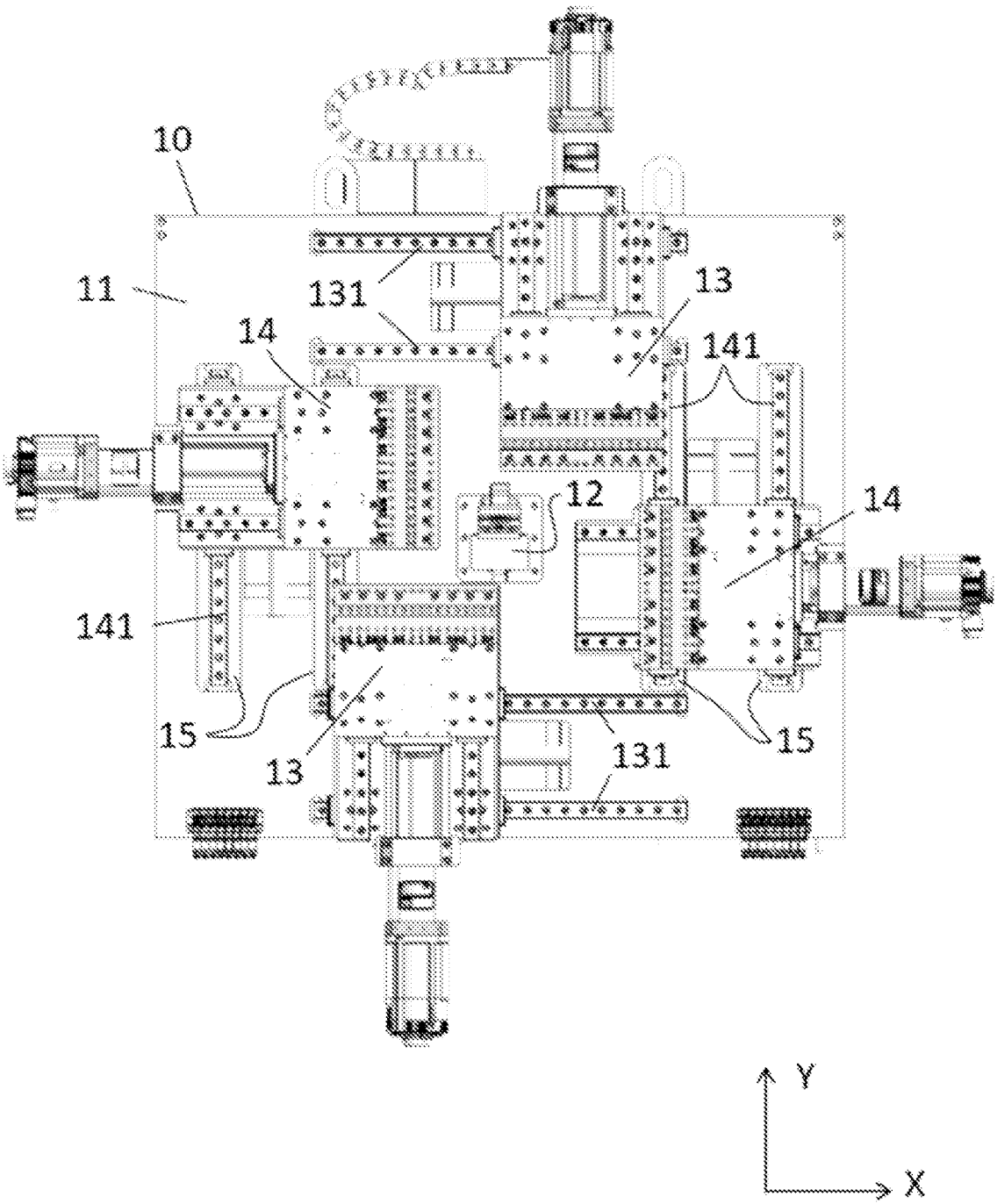
FIG. 3 is a front view of a base of the spring coiling machine (with a platform residing at an end of a track)

FIG. 3 similarly shows a front view of the base (10) in FIG. 1, but the horizontal platform (13) and the vertical platform (14) both reside at ends of the tracks. Due to the configuration of the tracks, the vertical platform (14) residing at the end of the vertical track (141) does not extend to a range of the horizontal track (131), and in contrast, the horizontal platform (13) residing at the end of the horizontal track (13) extends to a range of the vertical track (141). However, according to the foregoing design of the recesses (15), the horizontal platform (13) does not structurally collide with the vertical track (14), allowing the horizontal platform (13) to reside at the end of the horizontal track (131) to achieve a maximum motion stroke.

Again referring to FIG. 1, the specific configuration of the spring coiling machine (1) is not limited to the example above, and a combination of manufacturing processing tools (not shown) varies depending on characteristics of spring products. The present invention is dedicated to solving manufacturing issues of large-sized springs beyond the capabilities of the spring coiling machine (1). A length of such large-sized spring may approximate or may be greater than the width, height or depth of the spring coiling machine (1), and the processing tools provided by the spring coiling machine (1) in FIG. 1 are inadequate for stably supporting such large-sized spring. FIG. 1 depicts a positioning apparatus (2) according to an embodiment of the present invention. The positioning apparatus (2) may be mounted on a stage (21) connected to the spring coiling machine (1) so that the positioning apparatus (2) is located at an appropriate position relative to the mechanical surface (11), for example, in the vicinity of the spring wire feed direction.

FIG. 1 further depicts a monitoring device (3) that can be placed in the vicinity of the positioning apparatus (2) for operating staff to monitor the spring product and parameters of the spring coiling machine (1) and the positioning apparatus (2). FIG. 1 further shows an example of a large-sized spring product (P), which is processed by the spring coiling machine (1) and is supported and held by the positioning apparatus (2) to prevent the spring product from tilting over due to an excess weight.

Figure 4:
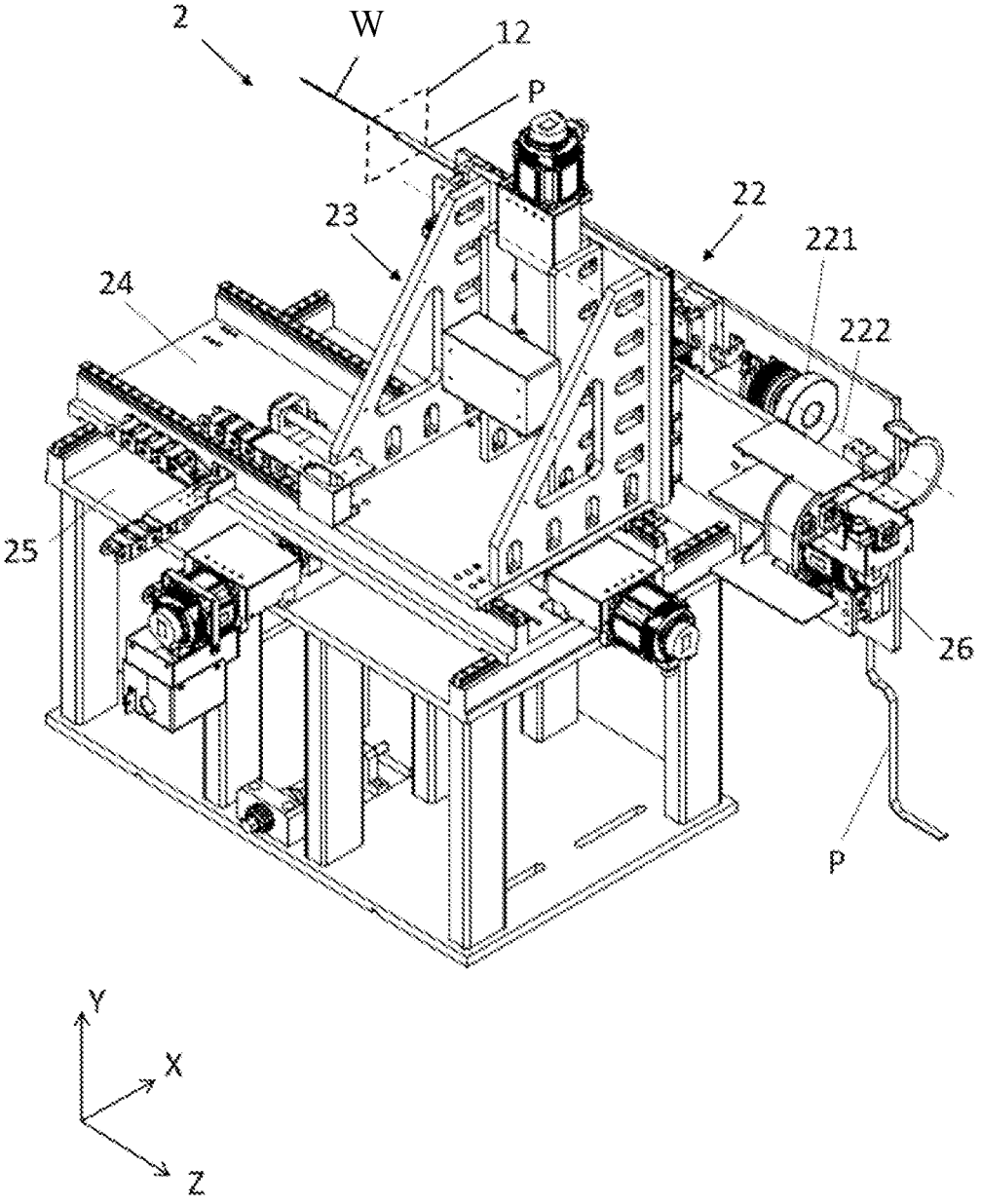
FIG. 4 is a three-dimensional diagram of a positioning apparatus of the present invention.

FIG. 4 shows a three-dimensional diagram of the positioning apparatus (2). The positioning apparatus (2) includes a positioning assembly, a lift assembly (23), a first platform assembly (24) and a second platform assembly (25). The positioning assembly includes a first guiding panel (22) that is movably connected to the lift assembly (23), and the lift assembly (23) has a driving motor for providing a lift means so that the first guiding panel (22) is vertically movable in the Y direction relative to the lift assembly (23). The first guiding panel (22) includes one or more driving assemblies (221) that are arranged between the first guiding panel (22) and the lift assembly (23) to drive the first guiding panel (22) to move pivotally according to a shaft (222) of the driving assembly (221), so that the first guiding panel (22) is pivotally rotatable relative to the lift assembly (23). The shaft (222) is parallel to the Z direction, and so that the pivotal rotation is a motion parallel to the XY plane. A bottom portion of the lift assembly (23) is movably connected to a top portion of the first platform assembly (24), and the first platform assembly (24) includes a driving motor connected to the bottom portion of the lift assembly (23), so that the lift assembly (23) is movable back and forth in a first horizontal direction (that is, the Z direction) relative to the first platform assembly (24). A bottom portion of the first platform assembly (24) is movably connected to a top portion of the second platform assembly (25), and the second platform assembly (25) includes a driving motor connected to the bottom portion of the first platform assembly (24), so that the first platform assembly (24) is horizontally movable in a second horizontal direction (that is, the X direction) relative to the second platform assembly (25). The second platform assembly (25) is positioned at the stage (21) in FIG. 1, and so the position of the second platform assembly (25) is fixed relative to the spring coiling machine (1). Accordingly, the first guiding panel (22) can move in three different directions relative to the spring coiling machine (1). Moreover, it is illustrated in the drawing that the spring product (P) is held on the +X side of the positioning apparatus (2). FIG. 4 also shows the spring wire (W) being forwarded through the spring wire feed outlet (12).

Figure 5:
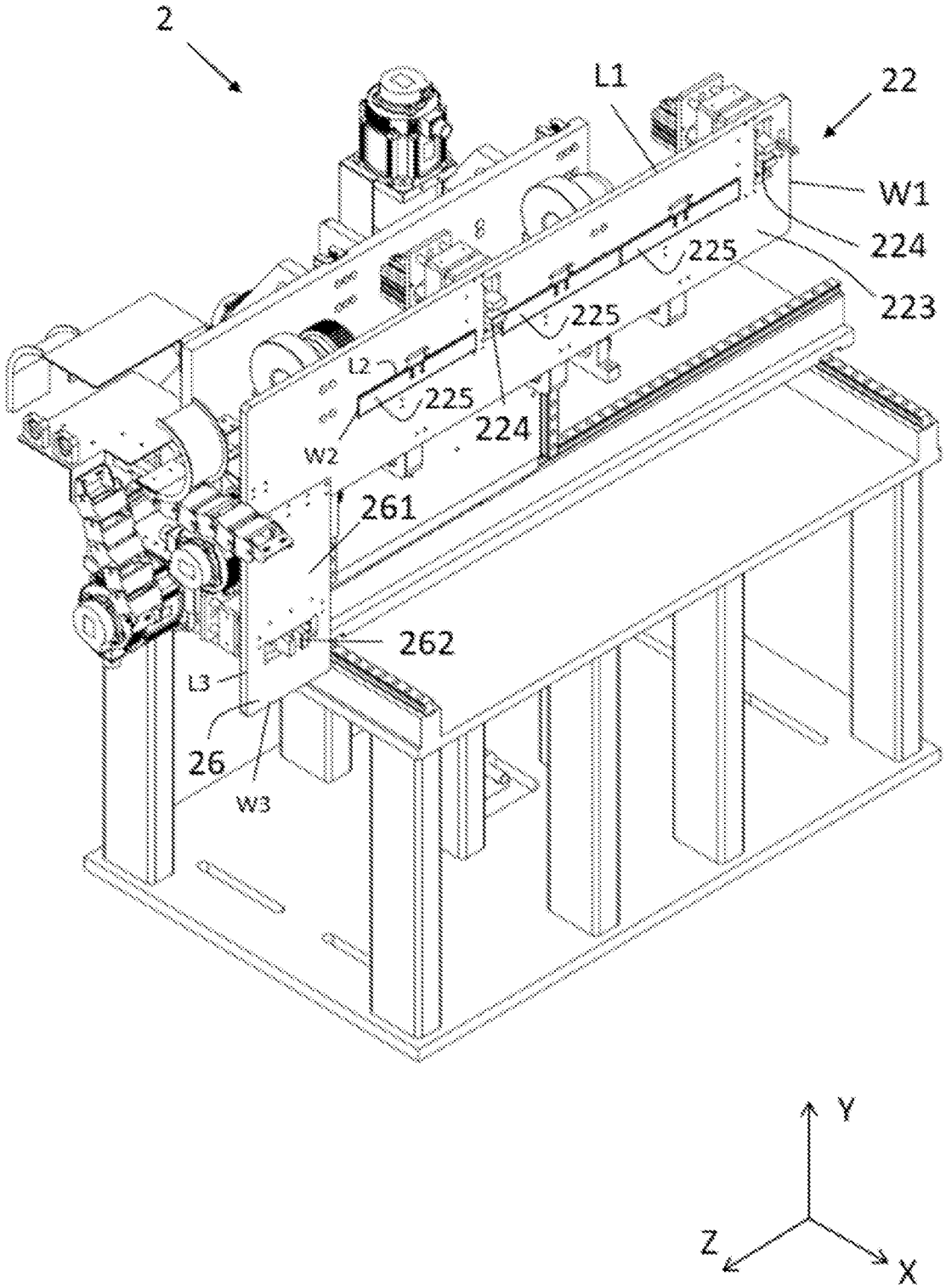
FIG. 5 to FIG. 10 show various states of a positioning apparatus of the present invention, respectively.

FIG. 5 shows another diagram of the positioning apparatus (2) of the present invention. The first guiding panel (22) has a first guiding surface (223) for guiding a spring product, wherein the first guiding surface (223) has a length (that is, the long side, L1) and a width (that is, the short side, W1). A lengthwise direction of the first guiding surface (223) is fundamentally parallel to the shaft (222) and the Z direction, and the widthwise direction of the first guiding surface (223) is perpendicular to the lengthwise direction. In FIG. 5, the first guiding panel (22) is located on a highest position of the lift assembly (23) and the first guiding surface (223) is orthogonal to the X direction. The end of the first guiding panel (22) extending toward the −Z direction is close to the mechanical surface (11) of the spring coiling machine (1), and the end of the first guiding panel (22) extending toward the +Z direction is away from the mechanical surface (11). Thus, in response to feeding toward the +Z direction, the fed spring product first enters the end of the first guiding panel (22) extending toward the −Z direction.

Multiple first mechanical holding members (224), for example, two in quantity as shown in the embodiment of the drawing, are arranged on the first guiding surface (223), and are arranged along a direction of the length (L1). Two adjacent first mechanical holding members (224) are spaced by a distance in between. These first mechanical holding members (224) may be a fixture, and are controlled by respective driving motors to hold a first part of the spring product. For example, the first mechanical holding members (224) may hold a part of the spring product extending in the Z direction. Although the first mechanical holding members (224) in the drawing are at the same positions in the Y direction, the present invention is not limited to such example.

The first guiding panel (22) further includes multiple support boards (225) for supporting the spring product. These support boards (225) are arranged in a direction (that is, the Z direction) of the length (L1). For example, there are three support boards (225) shown in the drawing, and two of those are located between the adjacent first mechanical holding members (224), and the other is close to a feed end of the first guiding panel (22). These support boards (225) have a same support surface having a length (for example, a long side, L2) and a width (for example, a short side, W2), wherein the length (L2) is parallel to the feed direction (the +Z direction), and the width (W2) is perpendicular to the length (L2). Other details of the support boards (225) are to be described with reference to FIG. 9 below.

The first guiding panel (22) is further connected to a second guiding panel (26) which has a second guiding surface (261) for guiding the spring product. The second guiding surface (261) has a length (for example, a long side, L3) and a width (for example, a short side, W3), wherein the width (W3) is parallel to the length (L1) of the first guiding panel (22). The short side (W3) of the second guiding panel (26) is connected to the feed end of the first guiding panel (22), so that the first guiding panel (22) and the second guiding panel (26) form an L shape; however, the present invention is not limited to the example above. The length (L3) of the second guiding panel (26) may be appropriately selected, so that the second guiding panel (26) does not produce interference against the second platform assembly (25) when moving in the X direction.

Similarly, a second mechanical holding member (262) is arranged on the second guiding surface (261) and selectively holds a second part of the spring product. For example, the second mechanical holding member (262) may be a fixture, and is driven to hold a part of the spring product extending in the Y direction. Thus, when the first mechanical holding member (224) and the second mechanical holding member (262) are in a state of holding the spring product, the spring product may be at least in a shape of the spring product (P) shown in FIG. 1.

Figure 6:
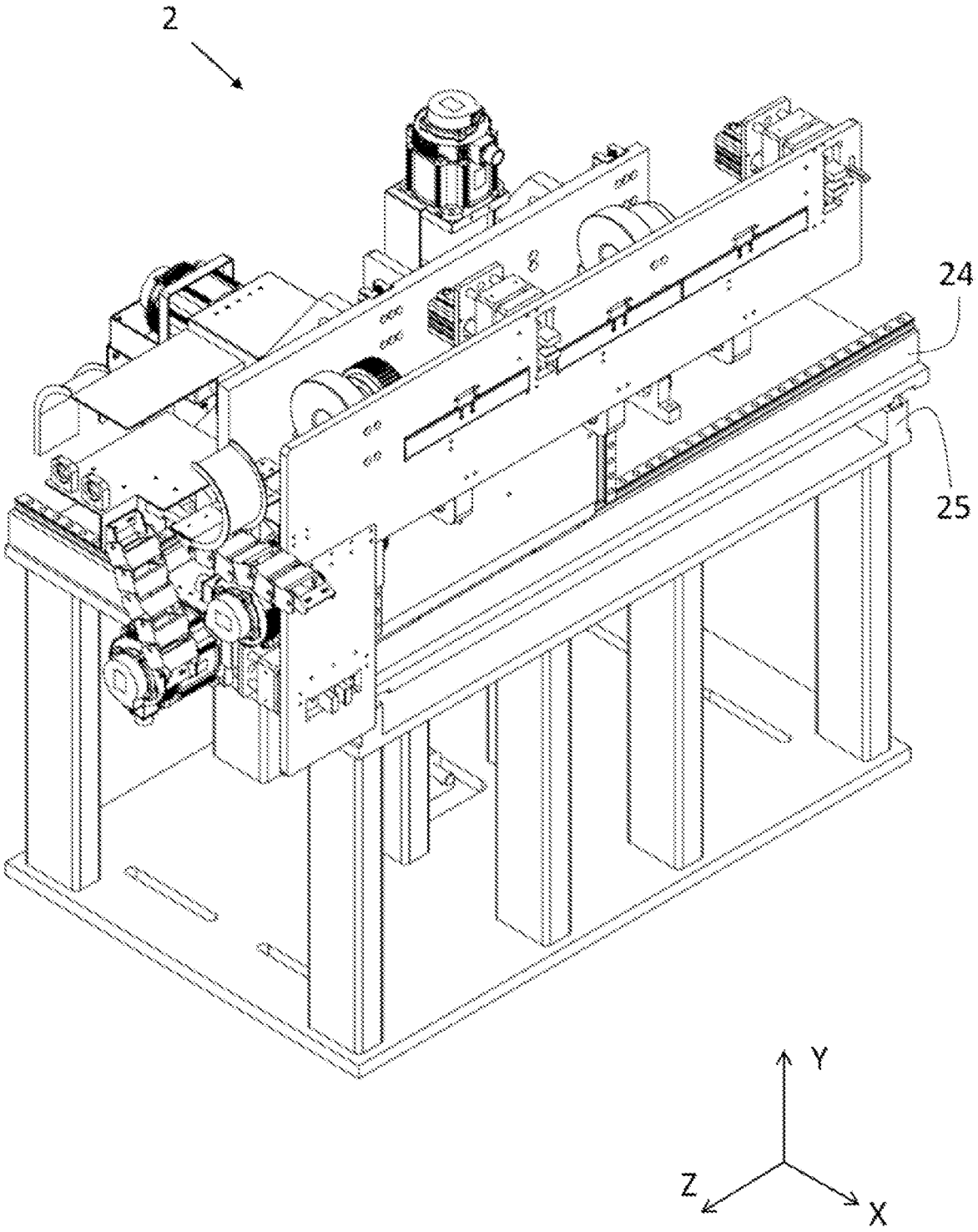
Figure 7:
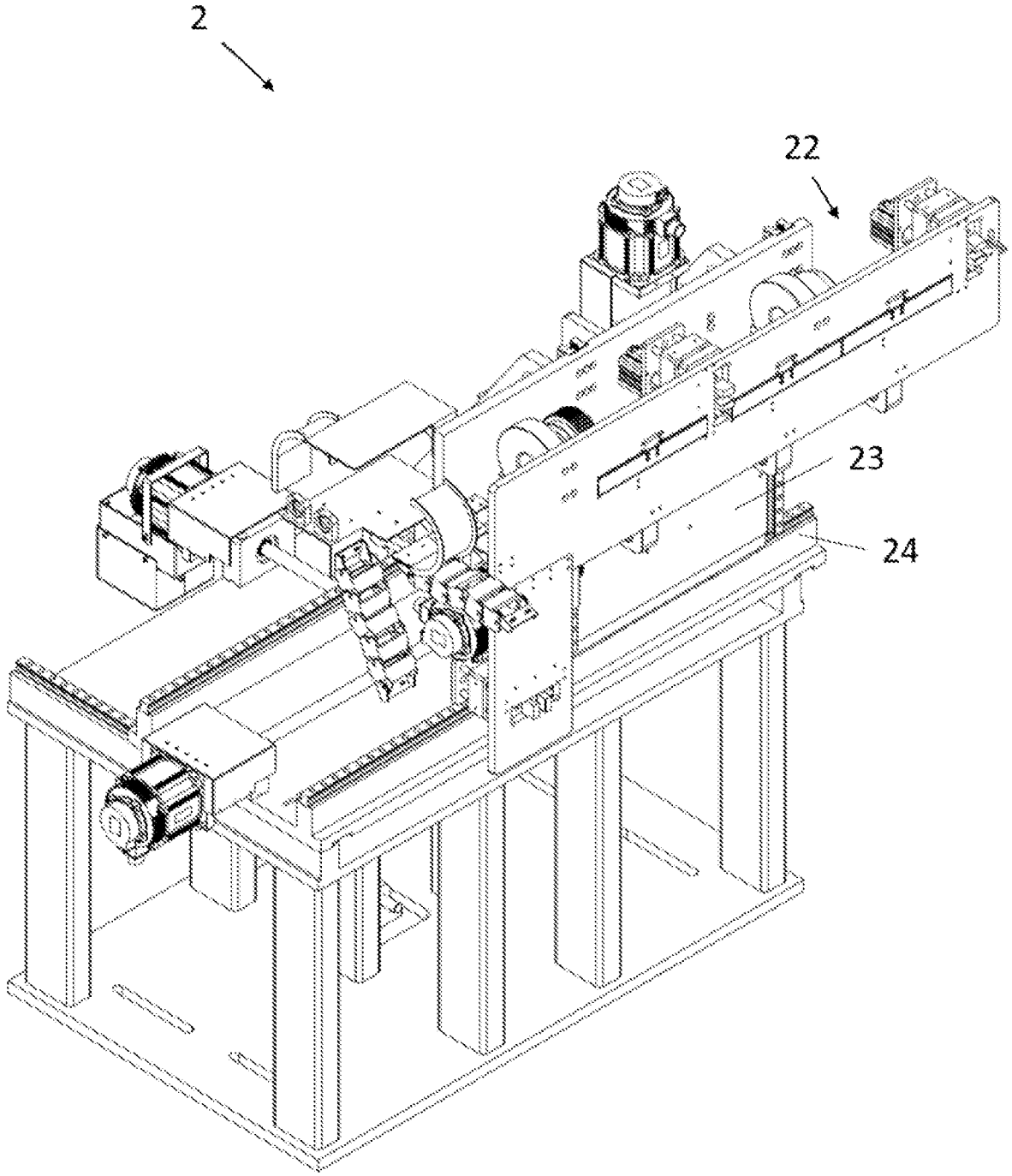
Figure 8:
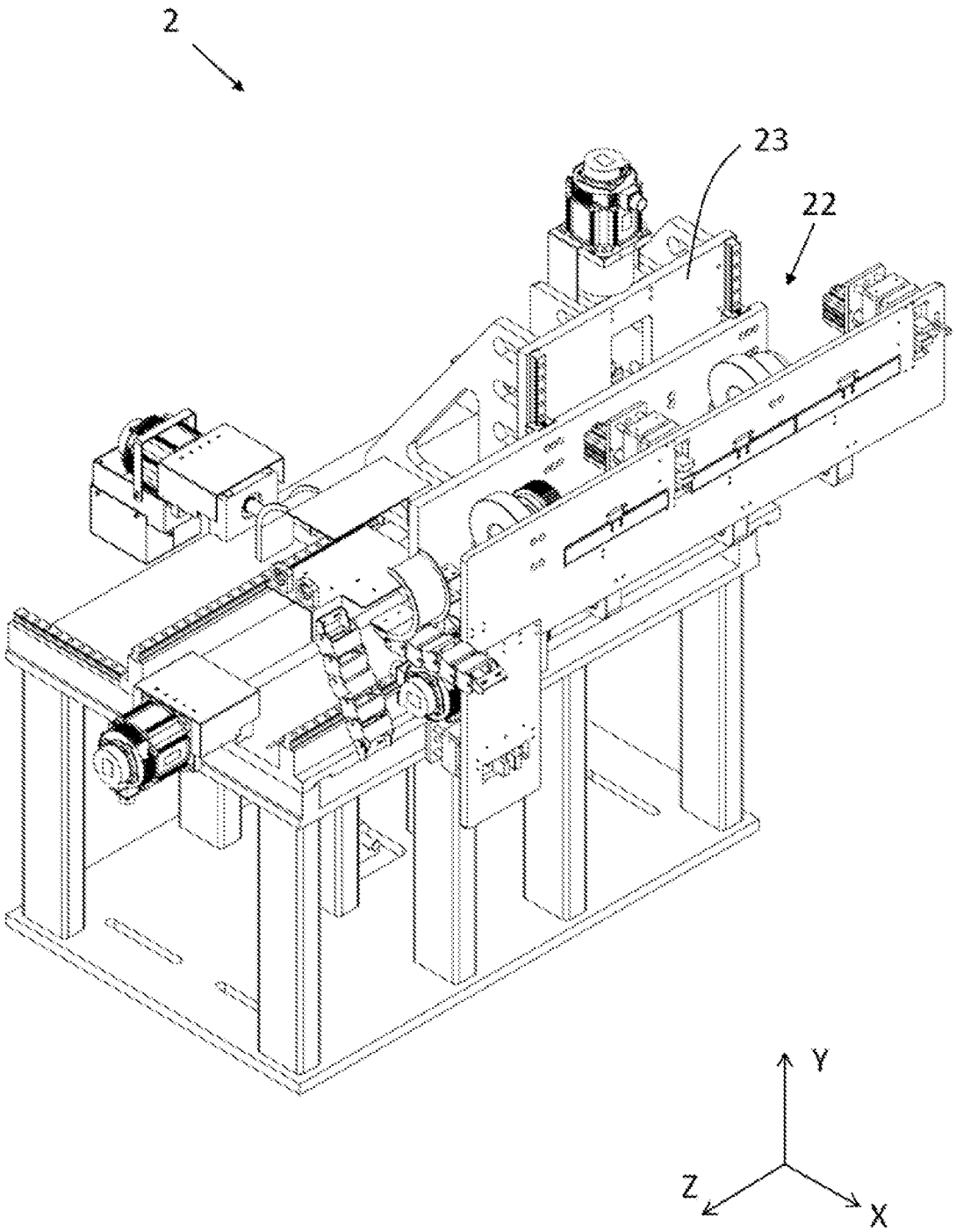
Figure 9:
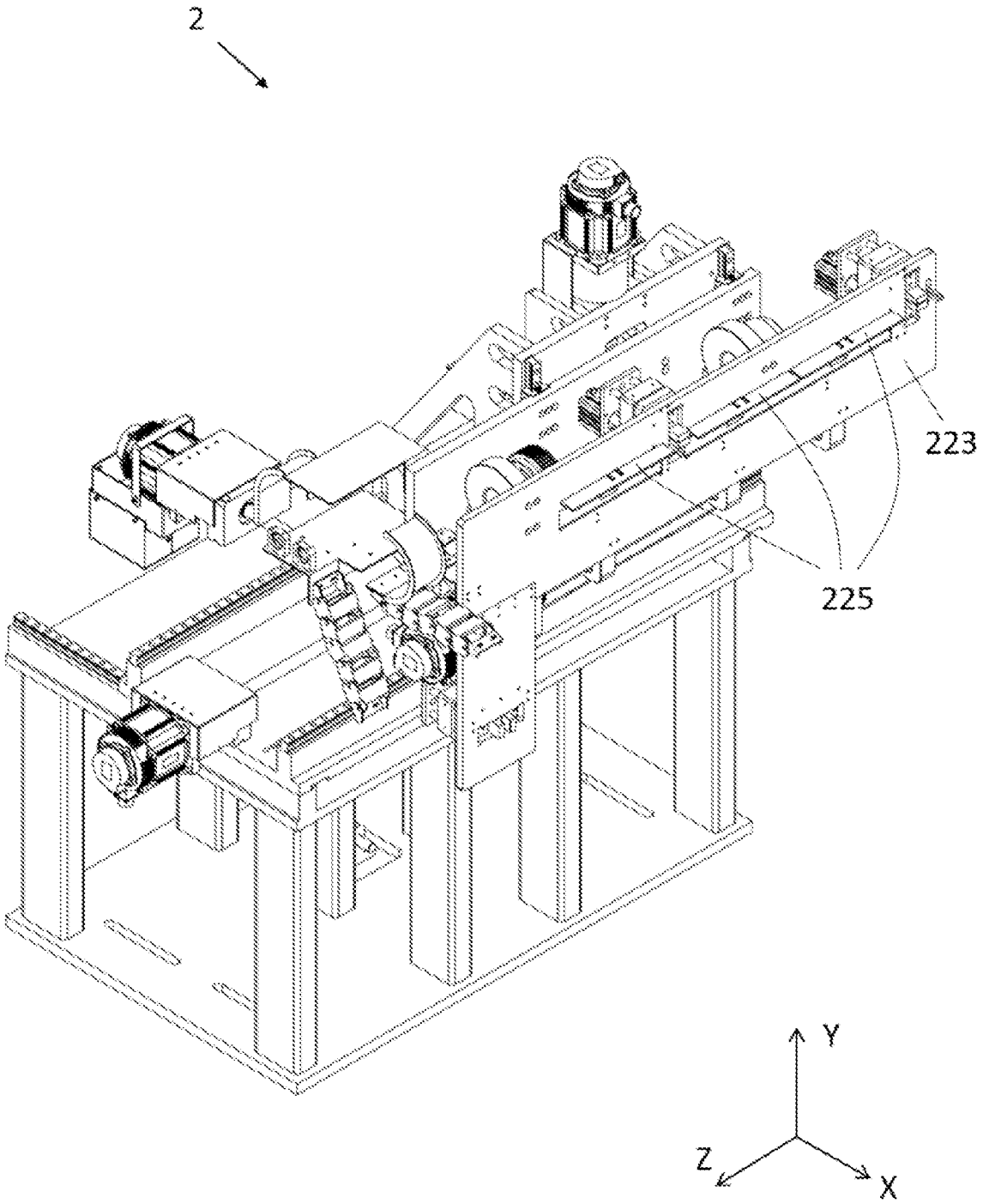
Figure 10:
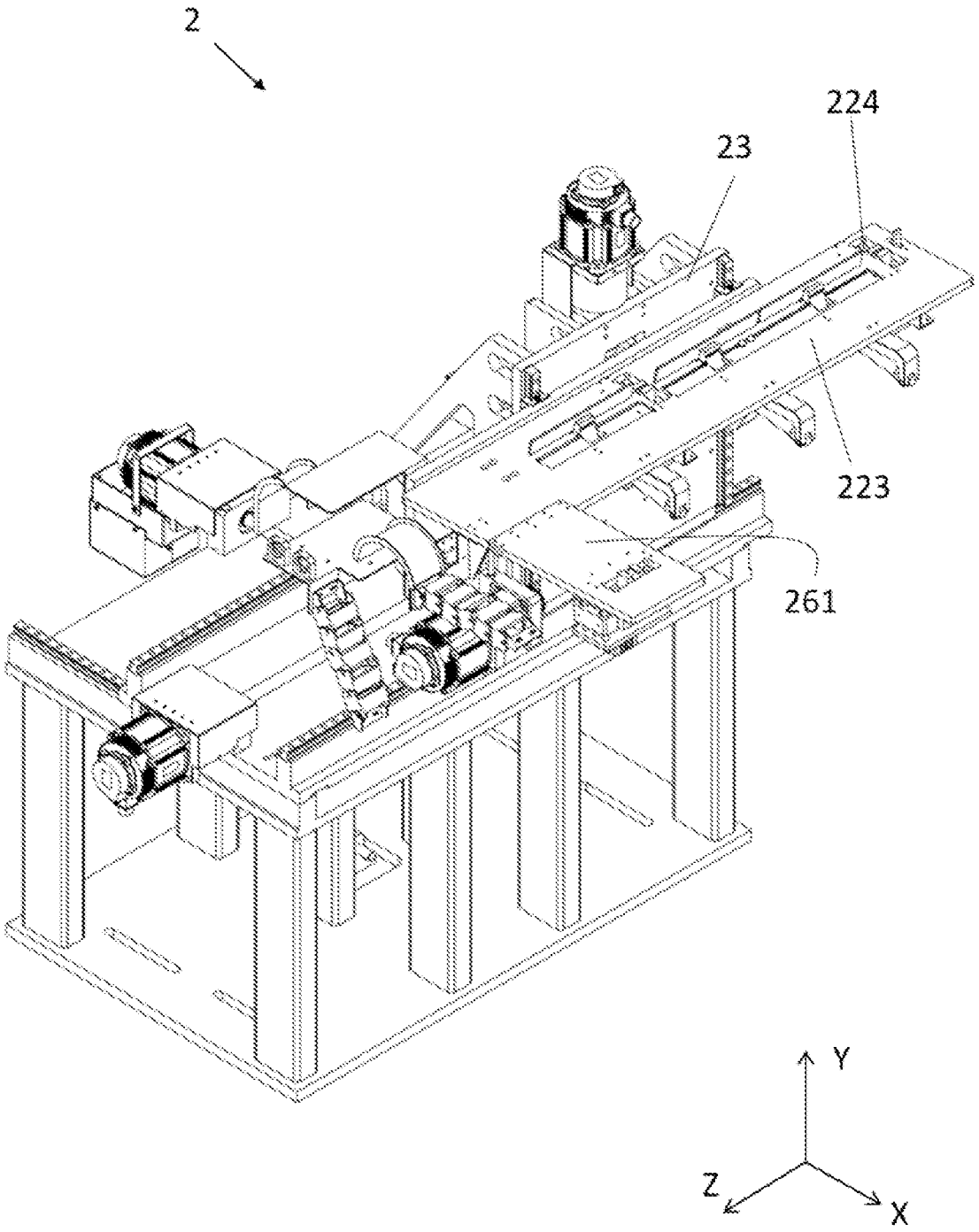

FIG. 6 shows a residing state of the positioning apparatus (2). Compared to FIG. 5, the first platform assembly (24) is moved in the +X direction to the end of the second platform assembly (25) relative to the second platform assembly (25). FIG. 7 shows another residing state of the positioning apparatus (2). Compared to FIG. 6, the lift assembly (23) is receded in the −Z direction relative to the first platform assembly (24), so that the first guiding panel (22) is in its entirety close to the mechanical surface (11) in FIG. 1. FIG. 8 shows yet another residing state of the positioning apparatus (2). Compared to FIG. 7, the first guiding panel (22) is in its entirety descended in the −Y direction relative to the lift assembly (23). FIG. 9 shows yet another residing state of the positioning apparatus (2), wherein the support board (225) is in an activated state. Compared to FIG. 8, the first guiding panel (22) is slightly elevated toward the +Y direction relative to the lift assembly (23) and the support board (225) is flipped up from a retracted position to a support position, so that the support surface and the first guiding surface (223) are orthogonal, thereby supporting the spring product on the support boards (225). When the spring product progresses in the feed direction (the +Z direction) and passes through the first one of the first mechanical holding member (224), the spring product may be tilted in the −Y direction due to the weight. The support board (225) may be configured to be activated timely to support the bottom portion of the spring product, preventing the spring wire from tilting and thus from affecting processing and shaping. FIG. 10 shows yet another residing state of the positioning apparatus (2). Compared to FIG. 9, the first guiding panel (22) and the second guiding panel (26) are turned about the shaft (222) as the center by an angle relative to the lift assembly (23), so that the first guiding surface (223) and the second guiding surface (261) are perpendicular to the Y direction, the spring product is also rotated in synchronously with the first guiding panel (22) and the second guiding panel (26), and the spring product is twisted relative to the spring wire at the feed outlet (12) in FIG. 2. It should be noted that, the actual application is not limited to the example above.

Figure 11:
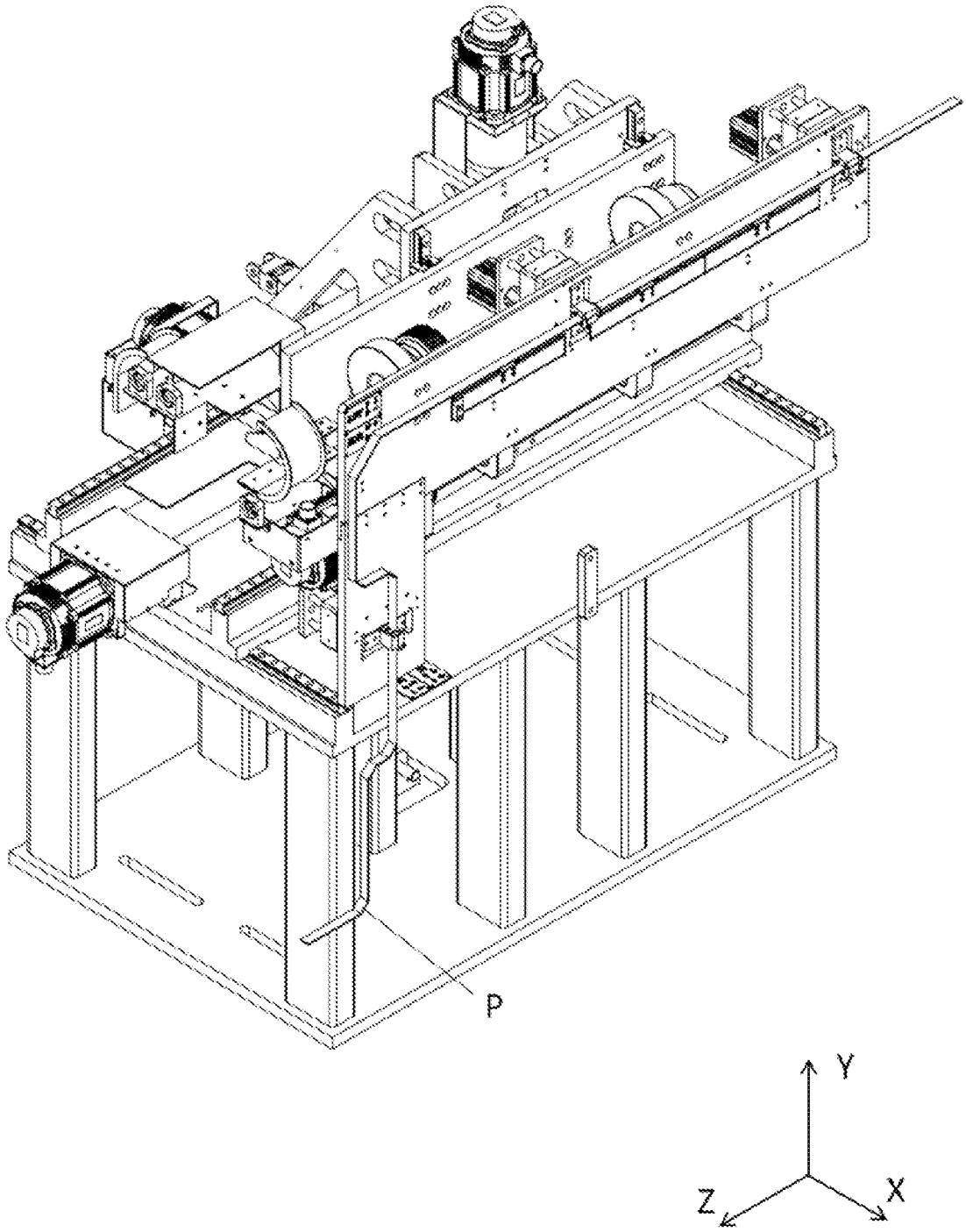
FIG. 11 and FIG. 12 illustrate the orientation of a spring product changed by a positioning apparatus of the present invention.
Figure 12:
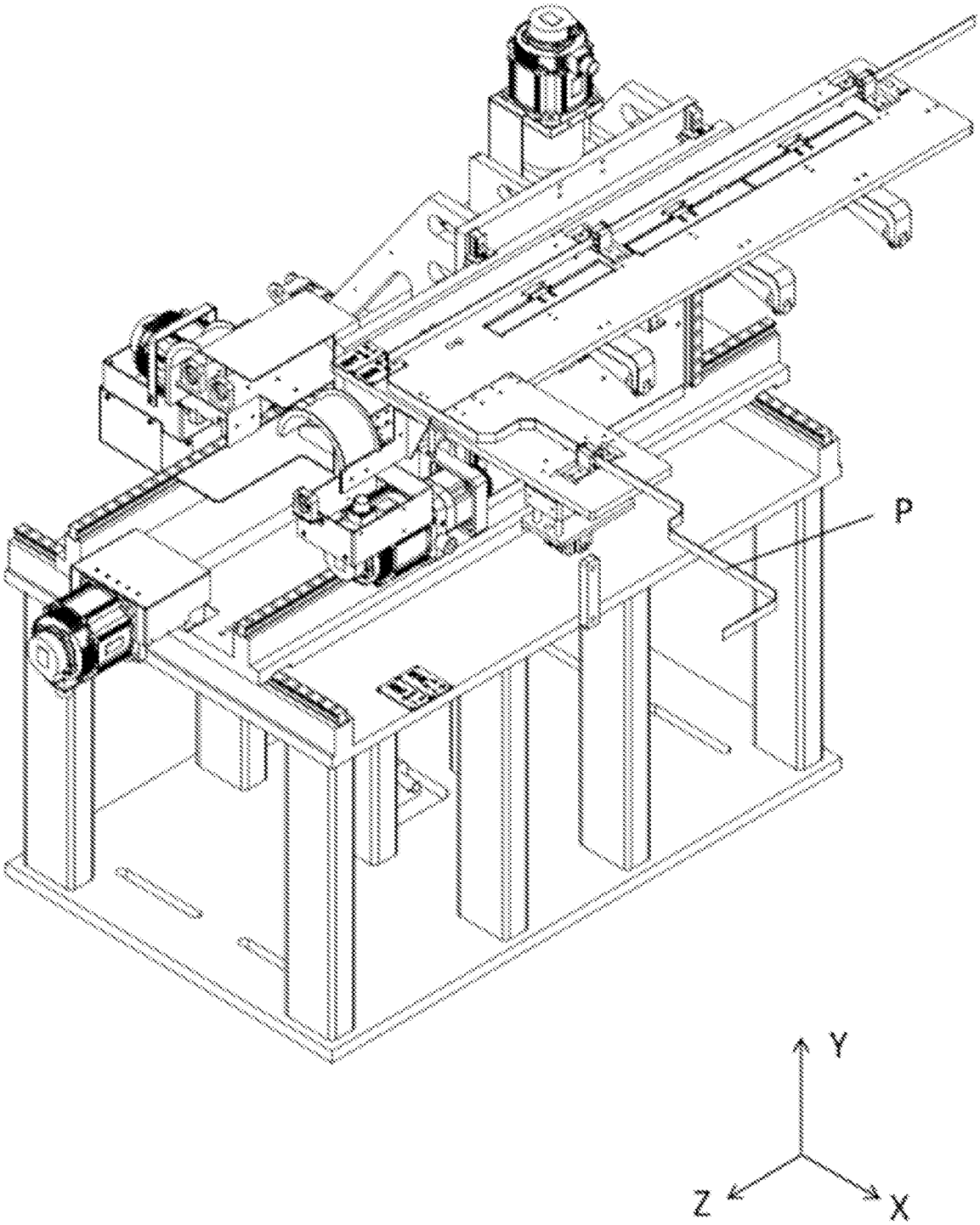

FIG. 11 and FIG. 12 show that, when the positioning apparatus (2) holds the spring product (P), the spring product (P) can be located in two different orientations by the rotation to better meet processing requirements.

Again referring to FIG. 1, a stamping apparatus (4) may also be arranged next to the positioning apparatus (2) and may be movably installed on the stage (21), so that the stamping apparatus (4) may selectively process the spring product held by the positioning apparatus (2).

Figure 13:
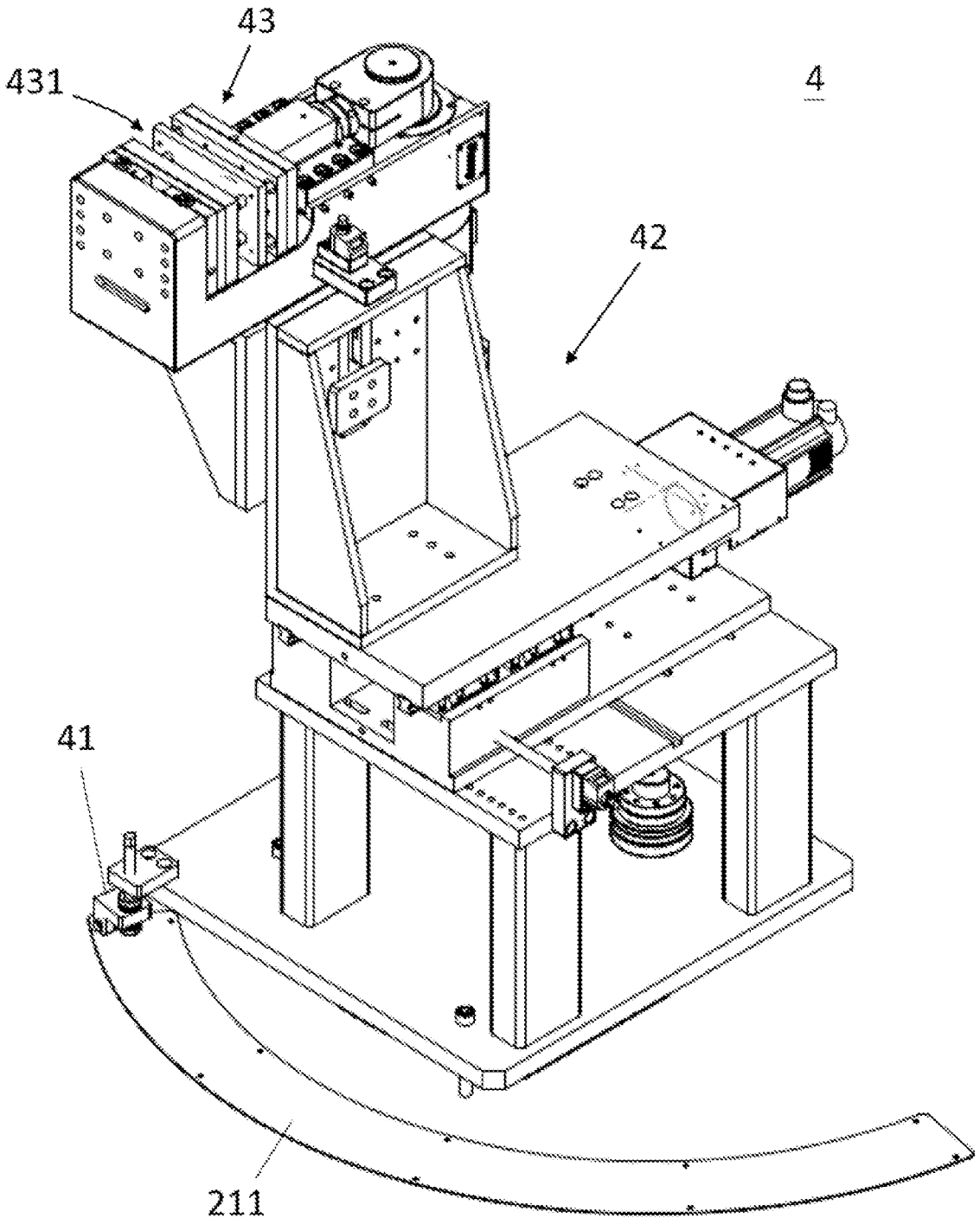
FIG. 13 depicts a stamping apparatus according to an embodiment.

FIG. 13 shows the stamping apparatus (4) according to an embodiment, and a bottom end of the stamping apparatus (4) is pivotally connected to a surface of the stage (21), so that the stamping apparatus (4) may pivotally rotate about a pivotal shaft (not shown) as the center. The bottom end of the stamping apparatus (4) may be provided with a sliding mechanism (41) that is slidable along a (stainless steel) metal gasket (211) fixed on the stage (21), thus reducing friction between the sliding mechanism (41) and the surface of the stage (21). Similarly, the stamping apparatus (4) includes a motion assembly (42) such as the positioning apparatus (2), that is, a combination of the lift assembly and the platform assembly above, enabling the stamping apparatus (4) to provide a three-axis motion mechanism, and such repeated details are omitted herein. A top end of the stamping apparatus (4) is provided with a horizontal stamping mechanism (43), which is defined with a passage (431) for accommodating a product to be stamped. The positioning apparatus (2) and the stamping apparatus (4) can coordinate with each other to allow a part of the spring product to enter the passage (431) for stamping processing.

Figure 14A:
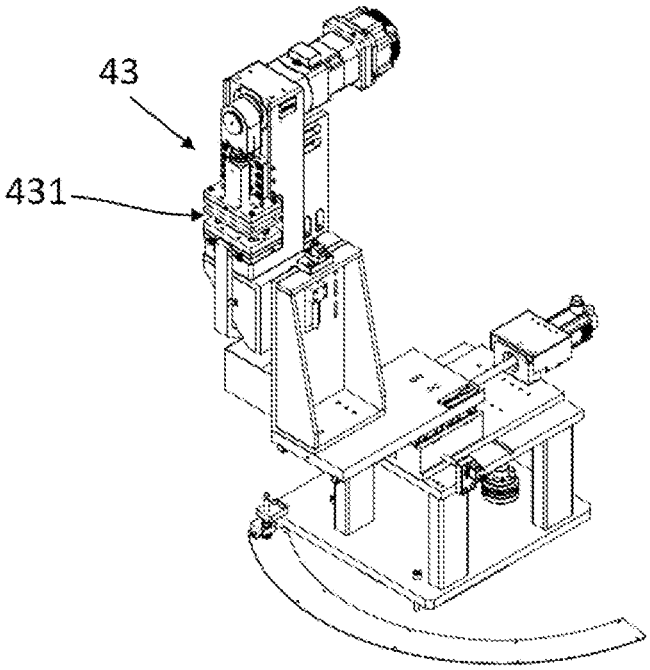
FIG. 14A and FIG. 14B depict a stamping apparatus according to another embodiment and its movable mechanism.
Figure 14B:
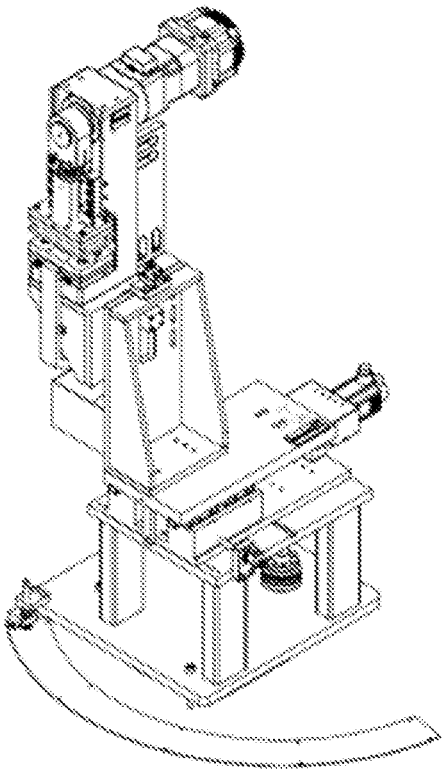

FIG. 14A and FIG. 14B show the stamping apparatus (4) according to another embodiment, in which the stamping mechanism (43) is positioned in a different orientation and performs stamping in a vertical direction when compared to FIG. 13. Moreover, one platform assembly may drive and impel the stamping mechanism (43) to move horizontally toward a direction.

Figure 15:
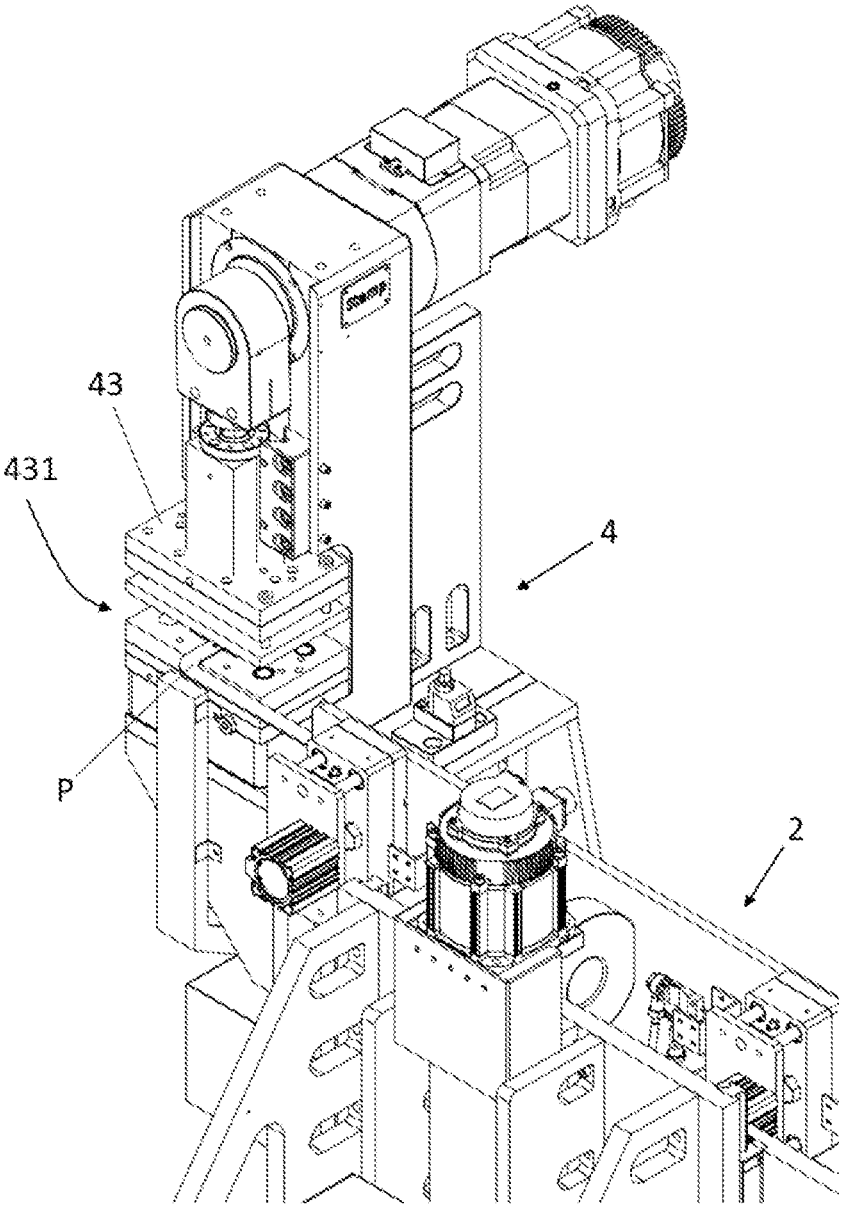
FIG. 15 depicts coordination between a positioning apparatus and a stamping apparatus.

FIG. 15 specifically shows the coordination between the positioning apparatus (2) and the stamping apparatus (4) of the present invention, and a section of a spring product (P) held by the positioning apparatus (2) passes through the passage (431) of the stamping mechanism (43). Thus, the spring product (P) may undergo stamping processing to form a specific structure, for example, a stamping hole.

Figure 16:
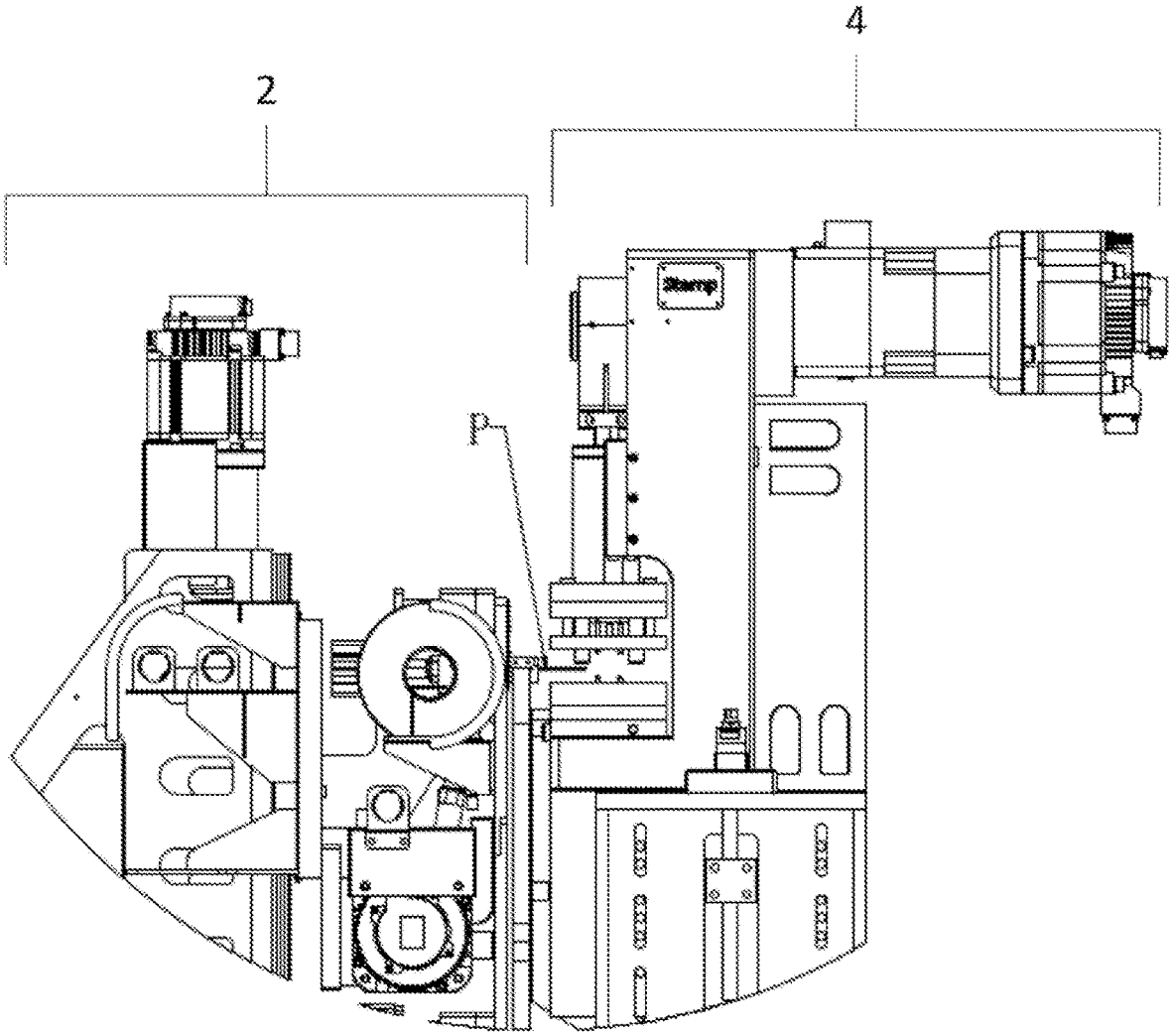
FIG. 16 depicts coordination between a positioning apparatus and a stamping apparatus from another perspective.

FIG. 16 shows the coordination between the position apparatus (2) and the stamping apparatus (4) of the present invention from another perspective, wherein the spring product (P) is held on one side of the foregoing guiding surface by the positioning apparatus (2), and the stamping apparatus (4) is moved appropriately so that the passage of the stamping mechanism and a to-be-processed section of the spring product (P) are substantially on the same height. After the spring product (P) is forwarded into the passage for stamping, the positioning apparatus (2) is receded from the processing position, allowing the spring product (P) to be removed from the passage and be forwarded to the next process.

Figure 17:
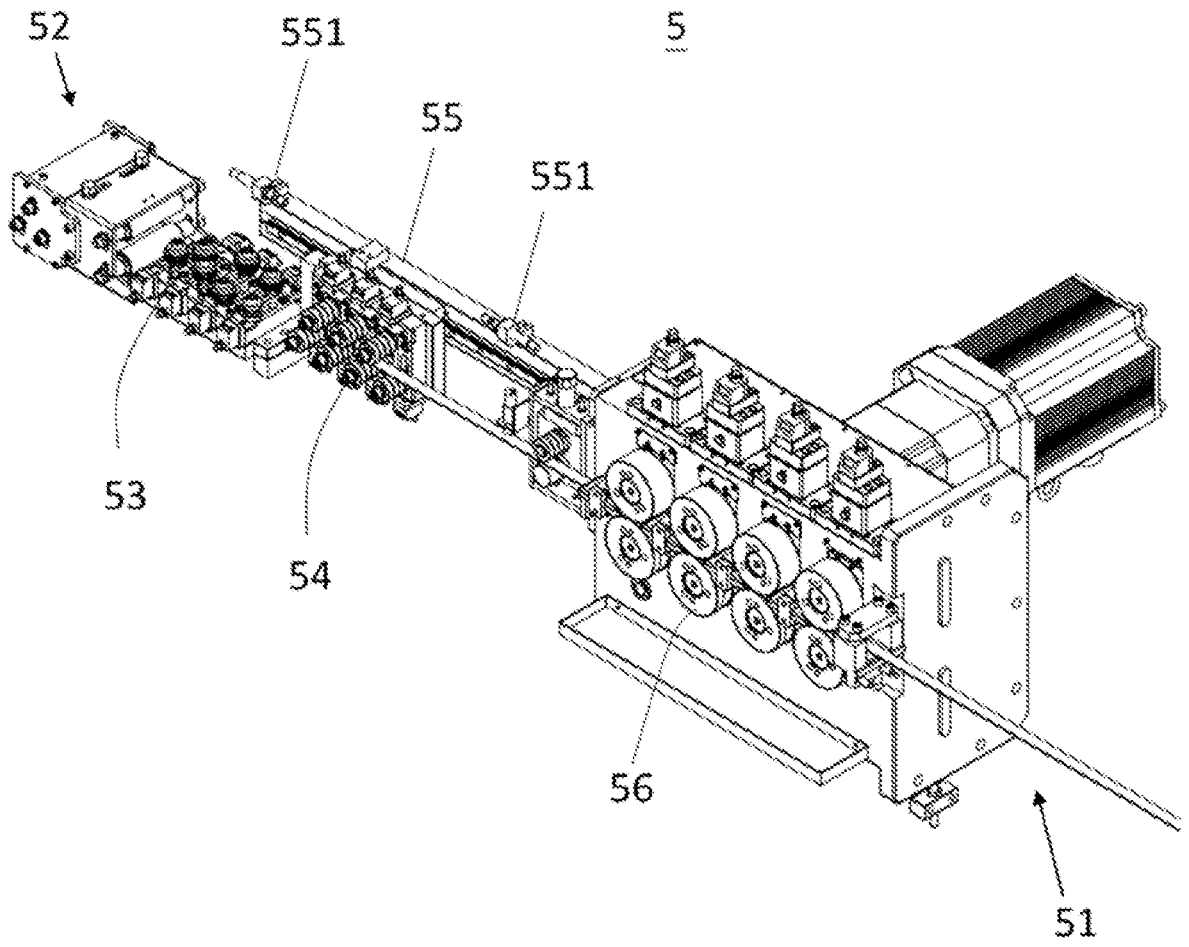
FIG. 17 depicts a feed assembly included in a spring coiling machine.

FIG. 17 shows a feed assembly (5) according to an embodiment, wherein the feed assembly (5) can be accommodated in, for example, a box of the spring coiling machine (1) shown in FIG. 1. A wire for making a spring is usually organized into a coil and placed at a rear end of the spring coiling machine (1). The wire organized into a coil is inevitably deformed and twisted since the wire is made of a metal material. Thus, when the wire is unrolled and drawn to the spring coiling machine (1), the wire needs to be shaped by a feed assembly so as to be restored to its real shape, that is, the wire is straightened and then fed to the surface of the base (10) for processing. Moreover, the spring coiling machine (1) does not always feed the wire in a forward direction. When the wire needs to be reversed to meet certain processing requirements or in the event of an error, the feed assembly feeds the wire toward the rear end. At this point in time, the already straightened structure may easily become undesirably deformed due to a change in the tension of the wire. Despite that such deformation may not be severe, the yield rate of spring products is nonetheless affected.

To solve the problem above, the present invention further provides a feed assembly (5) shown in FIG. 17, wherein the feed assembly (5) has a front end (51) close to the base (10) in FIG. 1 and a rear end (52) close to a source of the wire. A first feed device (53) is fixed in the box of the spring coiling machine (1) and is located at the rear end (52), and primarily consists of multiple arranged horizontal and vertical rollers to preliminarily flatten the wire.

A second feed device (54) is a movable feed device, and is slidably connected to a sliding track (55) in the box, so that the second feed device (54) is slidable within a limited range along the feed direction between the front end (51) and the rear end (52). The second feed device (54) consists of rollers arranged in the same direction, and receives the wire from the first feed device (53) and forwards the wire to a third feed device (56). The second feed device (54) may be located at an appropriate position on the sliding track (55), and coordinates with the third feed device (56) to straighten the wire. The second feed device (54) is not driven by a motor and hence moves on the sliding track (55), but is drawn by the wire and thus moves on the sliding track (55).

The sliding track (55) may be configured with a sensing unit (551) for sensing whether the second feed device (54) has moved to an end. An excess motion range of the second feed device (54) may represent mechanical malfunction, and the spring coiling machine (1) may then accordingly terminate all operations currently being performed.

The third feed device (56) also consists of multiple rollers arranged in the same direction, and is primarily for forwarding the straightened wire to the base (10) in FIG. 1 for processing. When the spring coiling machine (1) performs the operation of reversing the wire, the third feed device (56) pulls back the wire from the base (10) to the rear end (52). At this point in time, a movable mechanism of the second feed device (54) can disperse the tension withstood by the reversed wire, and this is conducive to maintaining the linearity of the reversed wire. As such, when the spring coiling machine (1) again feeds the wire forward, it is ensured that the wire is kept straight.

On the basis of the disclosure above, the present invention provides a positioning apparatus for positioning a spring product fed from a spring coiling machine, enhancing the feasibility for manufacturing of large-sized spring products.

What is claimed is:

1. A positioning apparatus configured for positioning a spring product fed from a spring coiling machine, the positioning apparatus comprising:

a positioning assembly, comprising:

a first guiding panel, having a first guiding surface for guiding the spring product, the first guiding surface having a length and a width; and a plurality of first mechanical holding members, arranged on the first guiding surface in a direction of the length of the first guiding surface, the plurality of the first mechanical holding members are configured for selectively supporting and holding a first part of the spring product;

wherein, the first guiding panel is configured to be rotatable about a shaft of a driving assembly, and the shaft is parallel to the direction of the length of the first guiding surface, such that the spring product held on the first guiding panel is rotatable in synchronization with the first guiding panel and therefore twisted relatively to a spring wire from a feed outlet of the spring coiling machine.

2. The positioning apparatus according to claim 1, configured to be mechanically connected to the spring coiling machine, and a feed direction of the spring wire from the feed outlet of the spring coiling machine is parallel to the direction of the length of the first guiding surface.

3. The positioning apparatus according to claim 1, further comprising:

a second guiding panel, connected to the first guiding panel and having a second guiding surface for guiding the spring product, the second guiding surface having a length and a width, wherein the direction of the length of the first guiding surface is parallel to a direction of the width of the second guiding surface.

4. The positioning apparatus according to claim 3, further comprising:

a second mechanical holding member, arranged on the second guiding surface, and the second mechanical holding member is configured for selectively supporting and holding a second part of the spring product, wherein the first part and the second part of the spring product are not parallel.

5. The positioning apparatus according to claim 1, wherein the first guiding panel comprises a plurality of support boards that are arranged in the direction of the length of the first guiding surface, each of the support boards has a support surface having a length and a width, and each of the support boards is pivotally connected to the first guiding surface such that each of the support boards pivotally rotates between a retracted position and a support position, wherein each of the support surface of the support board at the retracted position is parallel to the first guiding surface of the first guiding panel, and each of the support surface of the support board at the support position is perpendicular to the first guiding surface of the first guiding panel such that the support surface supports the spring product being fed.

6. The positioning apparatus according to claim 1, wherein the first guiding panel is movably connected to a lift assembly, so that the shaft is movable in a vertical direction relative to the lift assembly.

7. The positioning apparatus according to claim 6, wherein the lift assembly is movably connected to a first platform assembly, so that the lift assembly is movable in a first horizontal direction relative to the first platform assembly, wherein the first horizontal direction is parallel to the shaft.

8. The positioning apparatus according to claim 7, wherein the first platform assembly is movably connected to a second platform assembly, so that the first platform assembly is movable in a second horizontal direction relative to the second platform assembly, wherein the first horizontal direction is not parallel to the second horizontal direction.

9. A system configured for positioning a spring product, the system comprises:

a positioning apparatus according to claim 1;

a spring coiling machine has a base, the base has a mechanical surface, and the spring coiling machine comprises:

a feed outlet of a spring wire, arranged on the mechanical surface to feed the spring wire along the feed direction of the spring wire;

a horizontal platform assembly, arranged on the mechanical surface and located above or below the feed outlet, the horizontal platform movably connected to the mechanical surface via one or more horizontal tracks; and a vertical platform assembly, arranged on the mechanical surface and located on one of two sides of the feed outlet, the vertical platform movably connected to the mechanical surface via one or more vertical tracks.

10. The system according to claim 9, wherein a length of the horizontal track is greater than a length of the vertical track, the horizontal track protrudes from the mechanical surface and the vertical track is correspondingly accommodated in a plurality of recesses formed on the mechanical surface, such that a distance between the horizontal platform and the mechanical surface is greater than a distance between the vertical platform and the mechanical surface, thereby reducing motion interference between the horizontal platform and the vertical platform.

11. A system configured for positioning a spring product, the system comprises:

a positioning apparatus according to claim 1;

a spring coiling machine comprising a stamping apparatus, movably coordinating with the positioning apparatus, enabling the spring product held by the positioning apparatus to undergo stamping processing.

12. A system configured for positioning a spring product, the system comprises:

a positioning apparatus according to claim 1;

a spring coiling machine comprising a feed assembly, having a front end, a rear end, and a feed device slidable between the front end and the rear end and for wire feeding, wherein the feed device is slidably connected to a sliding track, and the feed device is drawn by a wire to slide to accordingly disperse tension of the wire and maintain linearity of the wire.

* * * * *